US012146723B2

(12) United States Patent
Karchon et al.

(10) Patent No.: US 12,146,723 B2
(45) Date of Patent: Nov. 19, 2024

(54) DETACHABLE FIREARM GRIP ACCESSORY HAVING A TRITIUM LIGHT SOURCE

(71) Applicant: Cammenga Company, LLC, Dearborn, MI (US)

(72) Inventors: Christopher J. Karchon, Birmingham, MI (US); Alexander J. Karchon, Birmingham, MI (US)

(73) Assignee: SHERPA ENTERPRISES, LLC, Dearborn, MI (US)

( * ) Notice: Subject to any disclaimer, the term of this patent is extended or adjusted under 35 U.S.C. 154(b) by 0 days.

(21) Appl. No.: 18/224,978

(22) Filed: Jul. 21, 2023

(65) Prior Publication Data

US 2024/0027162 A1 Jan. 25, 2024

Related U.S. Application Data

(60) Provisional application No. 63/369,012, filed on Jul. 21, 2022.

(51) Int. Cl.
*F41C 23/10* (2006.01)

(52) U.S. Cl.
CPC ..... *F41C 23/10* (2013.01)

(58) Field of Classification Search
None
See application file for complete search history.

(56) References Cited

U.S. PATENT DOCUMENTS 9,097,474 B1 * 8/2015 Zins ..... F41A 5/02
9,322,610 B2 * 4/2016 Zajk ..... F41C 23/10

* cited by examiner

*Primary Examiner* — Reginald S Tillman, Jr.
(74) *Attorney, Agent, or Firm* — Dickinson Wright PLLC

(57) ABSTRACT

In some implementations, the device may include a body extending from a top portion to a bottom portion. In addition, the device may include at least one of said top portion or bottom portion defining a cavity. The device may include a tritium vial disposed in said cavity for allowing illumination produced by said tritium vial to be viewable by a user of the firearm.

14 Claims, 7 Drawing Sheets

DETACHABLE FIREARM GRIP ACCESSORY HAVING A TRITIUM LIGHT SOURCE

CROSS-REFERENCE TO RELATED APPLICATION

This patent application claims benefit and priority to U.S. Provisional Patent Application Ser. No. 63/369,012, filed Jul. 21, 2022, the entire disclosure of which is incorporated herein by reference.

BACKGROUND OF THE INVENTION

1. Field of the Disclosure

The present disclosure relates generally to a detachable backstrap for a firearm grip. More specifically, the present disclosure relates to a firearm backstrap which includes tritium.

2. Description of the Prior Art

This section provides a general summary of background information and the comments and examples provided in this section are not necessarily prior art to the present disclosure.

Tritium is a radioactive isotope of hydrogen which can be used as a luminary device for watches, compasses, knives, guns, tools, and the like. Naturally occurring tritium is extremely rare and thus too small for practical recovery. Accordingly, tritium is typically only produced in nuclear reactors and provided or retained within glass vials. However, the use of tritium in products, such as watches, compasses, knives, guns, tools, and the like, is closely regulated by various U.S. governmental organizations to protect the health and safety of the public and the environment. Toward that end, the use and incorporation of the tritium glass vials into said products is closely regulated by the federal government and any such use must sufficiently establish that the tritium vials are adequately protected from damage or breakage during their regular and everyday use. Absent such proof, the use and incorporation of tritium glass vials into said products is simply not permitted by the various U.S. governmental organizations.

Thus, there remains a significant and continuing need for aspects of incorporating tritium vials into components of firearm accessories, such as a backstrap, which are intended to meet these strict government regulations while correspondingly providing the aesthetic and luminary benefits which stem from the use of tritium in firearm backstraps.

SUMMARY OF THE INVENTION

This section provides a general summary of the disclosure and is not intended to be interpreted as a comprehensive listing of its full scope or of all of its objects, aspects, features and/or advantages.

In one general aspect, a backstrap may include a body extending from a top portion to a bottom portion. The backstrap may also include at least one of said top portion or bottom portion defining a cavity. The backstrap may furthermore include a tritium vial disposed in said cavity for allowing illumination produced by said tritium vial to be viewable by a user of the firearm.

Implementations may include one or more of the following features. The backstrap where the tritium vial is pill shaped and horizontally aligned with the bottom portion.

The backstrap where the tritium vial is pill shaped and vertically aligned with the top portion. The backstrap where the tritium vial is circular shaped. The backstrap including a member extending from the top portion of the backstrap for attaching to the firearm. The backstrap where the top portion is detachable from the bottom portion. The backstrap where the bottom portion includes at least one fastener hole for fitting a bolt through the bottom portion for securing the backstrap to the firearm. The backstrap where the bottom portion includes an adherent surface.

In one general aspect, the backstrap may include the backstrap shaped to conform to a shape of a portion of a handgrip of the firearm such that the firearm may be held in a firing position by the handgrip with the backstrap attached. The backstrap may also include a backstrap surface having an adherent surface interrupted by at least one horizontal section having a smooth surface. The backstrap may furthermore include the backstrap defining a cavity with at least one tritium vial disposed within said cavity for allowing illumination produced by said tritium vial to be viewable by a user of the firearm.

Implementations may include one or more of the following features. The backstrap where the adherent surface has of a repeating hexagonal pattern. The backstrap where the tritium vial is pill shaped and horizontally aligned with the backstrap. The backstrap which includes a member extending from a top of the backstrap for attaching to the firearm. The backstrap which includes at least one fastener hole for fitting a bolt through the backstrap for securing the backstrap to the firearm.

BRIEF DESCRIPTION OF THE DRAWINGS

The drawings described herein are for illustrative purposes only of selected embodiments and not all possible implementations, and are not intended to limit the scope of the present disclosure.

DETAILED DESCRIPTION OF THE ENABLING EMBODIMENTS

The devices described herein may be configured to attach to a firearm grip. In some embodiments the device may be attached by removing an original equipment manufacturer (OEM) backstrap and attaching one of the devices described herein. In some embodiments, the devices described herein may be configured to connect to the firearm by snapping into utilizing a member protruding from the top or bottom of the devices described herein. In some embodiments, the devices described herein may be configured to include one or more fastener holes for attaching one of the devices described herein to the firearm by attaching a fastener through the fastener hole and securing one of the devices described herein to the firearm. The fastener may be an adhesive, a mechanical fastener, a screw, a bolt, a nut, a rivet, a pin, a nail, a mechanical interlock, the like, or any combination thereof. In some embodiments, the devices described herein may be configured to utilize both a snap on mechanism and one or more fasteners in order to securely attach one of the devices described herein with the firearm.

The devices described herein may be configured to include a cavity which may securely hold a tritium vial. In some embodiments, a tritium vial may be comprised of a sealed glass container (e.g., borosilicate glass) filled with a gaseous form of tritium and a phosphor layer (e.g., doped zinc sulfide) applied to the inside of the glass vial. When the electrons emitted by the tritium gas interact with the phosphor layer, light is emitted. In some embodiments, different phosphor materials may be used to produce different colors (e.g., green, blue, red, yellow, orange, and white).

The devices described herein may be configured to include tritium vials in such a way as facilitating easier location of the firearm of the firearm in low light conditions (e.g., closet, glove box, safe, gun bag, etc.). In some embodiments, the tritium vial is placed near the bottom of the grip which allows a user to view the tritium vial while the user is holding the firearm in a firing position. In some embodiments, the placement of the tritium vial near the bottom of the firearm grip allows the user, in low light conditions, to be aware of the orientation of the firearm with respect to the user (e.g., laying on a side, right side up, upside down, back facing user, front facing user, etc.). In some embodiments, the placement of the tritium vial near the bottom of the firearm grip allows the user to more easily swap magazines.

The devices described herein may be configured to include one or more tritium vials in such a way as to be covered when held by a user in a firing position. In some embodiments, the one or more tritium vials allows the user to more easily determine the location of the firearm as well as the orientation of the firearm with respect to the user in low light conditions user (e.g., laying on a side, right side up, upside down, back facing user, front facing user, etc.).

Figure 1:
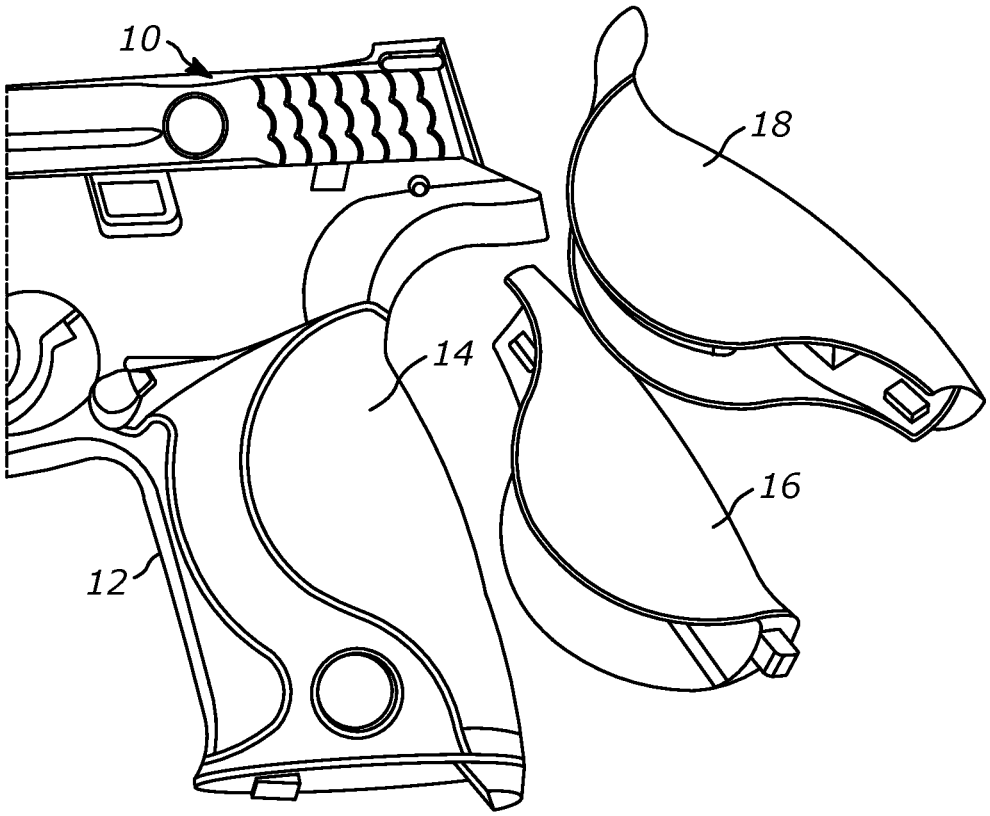
FIG. 1 illustrates a perspective view of a firearm and two backstraps aligned with the portion of the grip.

FIG. 1 illustrates a perspective view of a firearm 10 and two exemplary backstraps 16 to be aligned and installed on a portion of a firearm grip, in accordance with an aspect of the subject disclosure.

As best shown therein, the firearm 10 includes a firearm grip 12 where the user holds the firearm 10 when in a firing position. As shown in FIG. 1, the grip 12 has an OEM backstrap 14 already installed. According to one aspect, the example backstraps 16 may be installed on the firearm grip 12 when the OEM backstrap 14 is removed.

Figure 2:
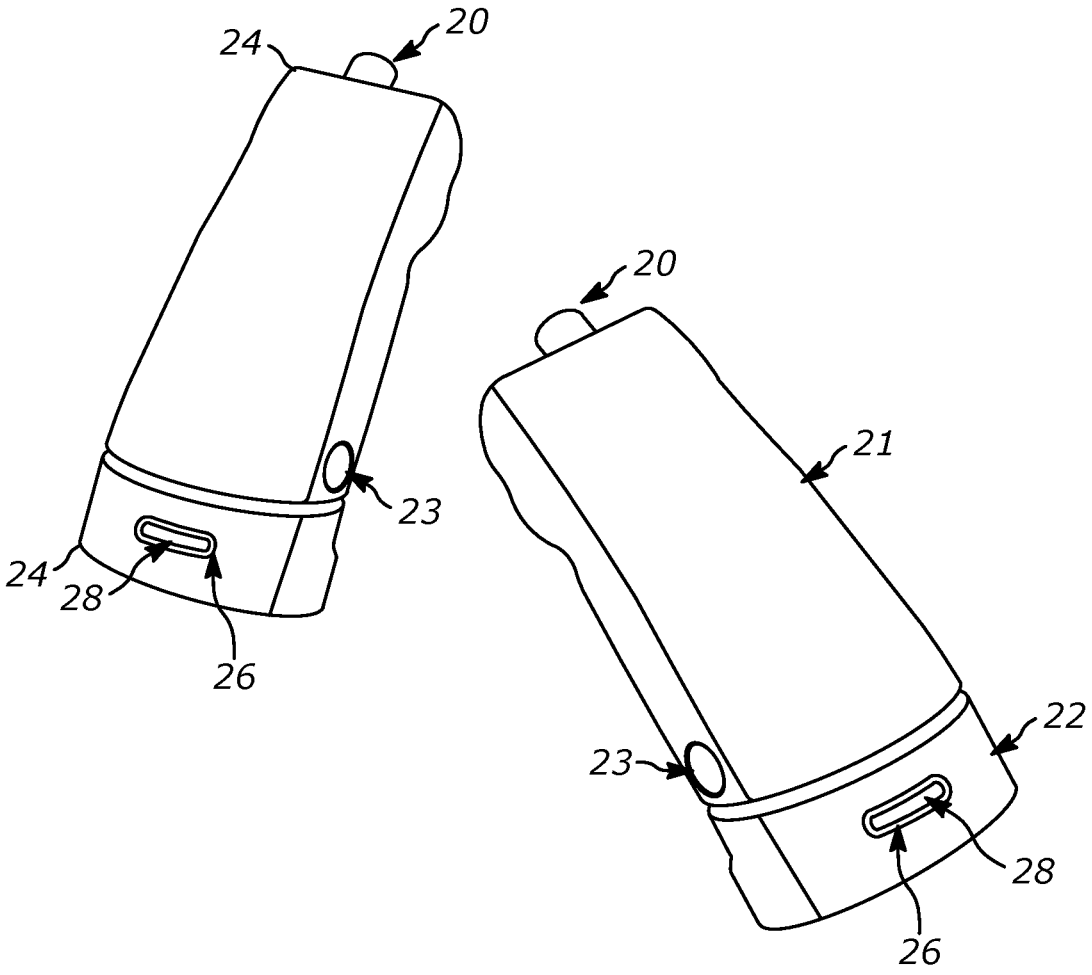
FIG. 2 is a perspective view of an example embodiment of two backstraps as viewed from the rear of the firearm when held in a firing position by a user, in accordance with an aspect of the present disclosure.

FIG. 2 illustrates a perspective view of an example embodiment of a backstrap 24 as viewed from the rear of the firearm 10 when held in a firing position by the user, in accordance with an aspect of the present disclosure.

As best shown therein, the body of backstrap 24 may extend from a top portion 21 to a bottom portion 22. In some embodiments, the top portion 21 or the bottom portion 22 may define a cavity 26. In some embodiments, a tritium vial 28 may be disposed in the cavity 26 for allowing illumination produced by said tritium vial to be viewable by a user of the firearm.

According to one aspect the, top portion 21 having a textured surface (a.k.a. an adherent surface) for increasing grip between the firearm grip 12 and the hands of the user when holding the firearm 10 in a firing position. According to one aspect, the textured surface may be any of, but not limited to, a rubberized surface, a lay surface texture, a wavy surface texture, a rough surface texture, a polished surface texture, a grit stone surface texture, a sandpaper surface texture, a glass bead blasted surface texture, a sand blasted surface texture, an electronic discharge machined molded surface texture, a satin blasted textured surface, a shiny finish surface texture, a semi-gloss finish surface texture, a matte finish surface texture, a textured finish surface texture, a granulate surface finish surface texture, and/or any combination thereof.

According to one aspect, the tritium vial 28 may be glued into the cavity 26. In some embodiments, opposing ends of the tritium vial 28 may be covered with rubber bumpers before the tritium vial 28 is inserted into the cavity 26. In some embodiments, once inserted, a threaded cap may be used to secure the ends of the cavity 26 to secure the tritium vial 28 to the cavity 26. In some embodiments, a protective holder can cover the open ends of the cavity 26 to secure the tritium vial to the cavity 26.

In some embodiments, the backstrap 24 may be installed on a firearm grip 12 to replace the OEM backstrap 14. In some embodiments, the backstrap 24 may wrap around the firearm grip 12 and attach without the need to remove the OEM backstrap 14.

As best shown therein, the backstrap 24 may include a member 20 extending from the top portion 21 for guiding the backstrap 24 into a snapping position relative to the firearm grip 12. According to one aspect, the member 20 may not retain the textured surface of the top portion 21. According to one aspect, the member 20 may be utilized as part of a snap-fit joint and may include a snap-in area for locking into place with a cantilever setup. In some alternative embodiments, the member 20 may be configured for use in an annular snap-fit joint or a torsional snap-fit joint.

As best shown therein, the backstrap 24 may include a bottom portion 22 that may be permanently affixed to the top portion 21 or removably affixed. According to one aspect, the bottom portion may be detachable from the top portion 21. According to one aspect, the bottom portion may include a cavity 26 which may house a tritium vial 28 and may allow illumination to visibly escape the cavity 26. In some embodiments, a tritium vial may be comprised of a sealed glass container (e.g., borosilicate glass) filled with a gaseous form of tritium and a phosphor layer (e.g., doped zinc sulfide) applied to the inside of the glass vial. When the electrons emitted by the tritium gas interact with the phosphor layer, light is emitted. In some embodiments, different phosphor materials may be used to produce different colors (e.g., green, blue, red, yellow, orange, and white).

In some embodiments, the tritium vial 28 is placed near the bottom of the grip which allows a user to view the tritium vial while the user is holding the firearm in a firing position. In some embodiments, the placement of the tritium vial 28 near the bottom of the firearm grip allows the user, in low light conditions, to be aware of the orientation of the firearm. The tritium vial 28 may have a cylindrical shape. In some embodiments, the tritium vial 28 may have a circular shape or a spherical shape. In some embodiments, the tritium vial 28 may have a box like shape or a flat rectangular shape.

As best shown therein, the backstrap 24 may include one or more fastener holes 23 for affixing the backstrap 24 to the firearm grip 12. In some embodiments, the backstrap 24 may be configured to include one or more fastener holes 23 for attaching one of the devices described herein to the firearm by attaching a fastener through the fastener hole 23 and securing the backstrap 24 to the firearm grip 12. The fastener may be an adhesive, a mechanical fastener, a screw, a bolt, a nut, a rivet, a pin, a nail, a mechanical interlock, any appropriate fastening mechanism, or any combination thereof.

Figure 3:
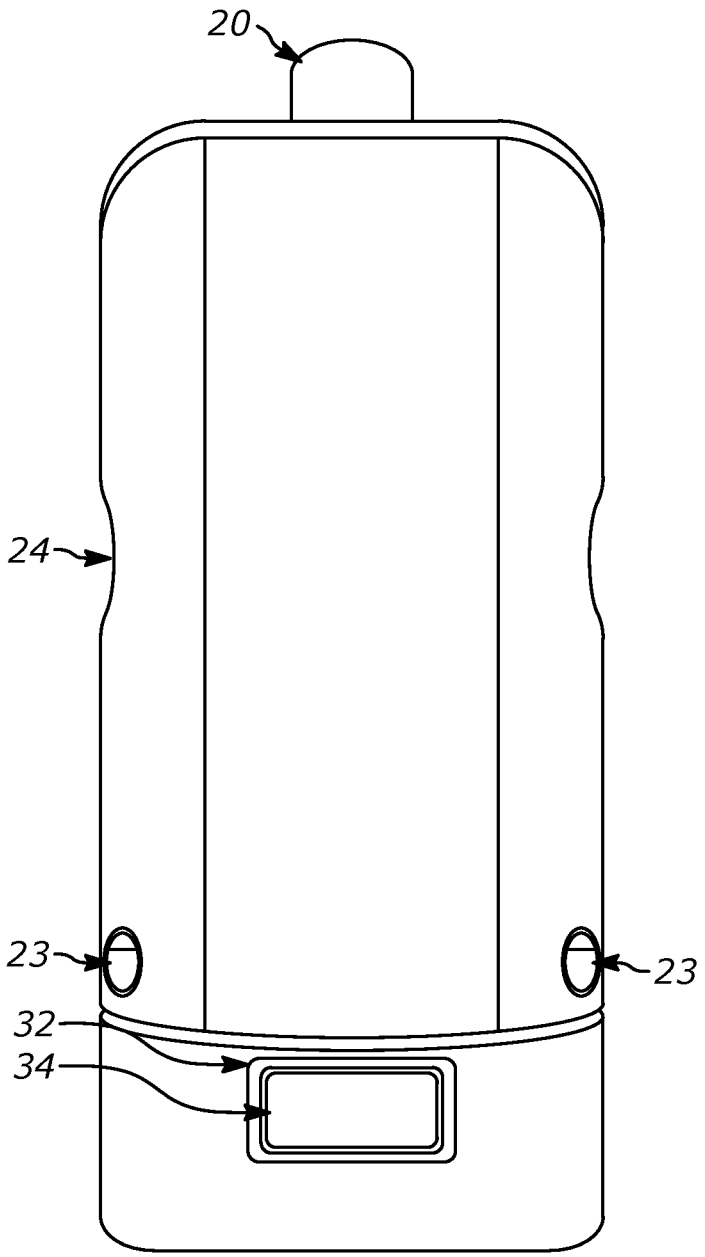
FIG. 3 is a perspective view of an example embodiment of the backstrap as viewed from the rear of the firearm when held in a firing position by the user, in accordance with an aspect of the present disclosure.

FIG. 3 illustrates a perspective view of an example embodiment of the backstrap 24 as viewed from the rear of the firearm 10 when held in a firing position by the user, in accordance with an aspect of the present disclosure.

As best shown therein, the backstrap 24 may include a cavity 32 which may house a tritium vial 34 and may allow illumination to visibly escape the cavity 32. In contrast to the cavity 26 and tritium vial 28 of FIG. 2 (which generates a line of tritium illumination), the cavity 32 and tritium vial 34 of FIG. 3 generates a rectangle of illumination.

Figure 4:
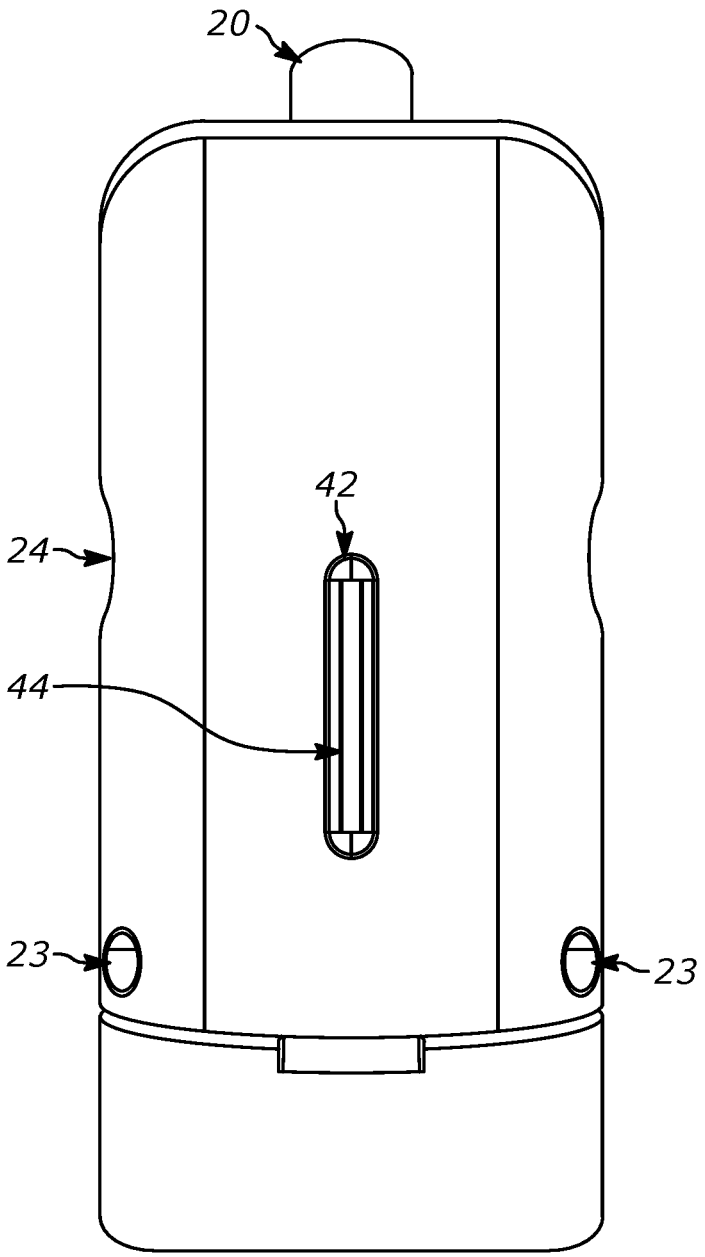
FIG. 4 is a perspective view of an example embodiment of the backstrap as viewed from the rear of the firearm when held in a firing position by the user, in accordance with an aspect of the present disclosure.

FIG. 4 illustrates a perspective view of an example embodiment of the backstrap 24 as viewed from the rear of the firearm 10 when held in a firing position by the user, in accordance with an aspect of the present disclosure.

As best shown therein, the backstrap 24 may include a cavity 42 and a tritium vial 44 on the top portion 21. In contrast to the cavity 26 and tritium vial 28 of FIG. 2 (which generates a line of tritium illumination on the bottom portion 22), the cavity 42 and tritium vial 44 of FIG. 4 generates a vertical line of tritium illumination on the top portion 21.

Figure 5:
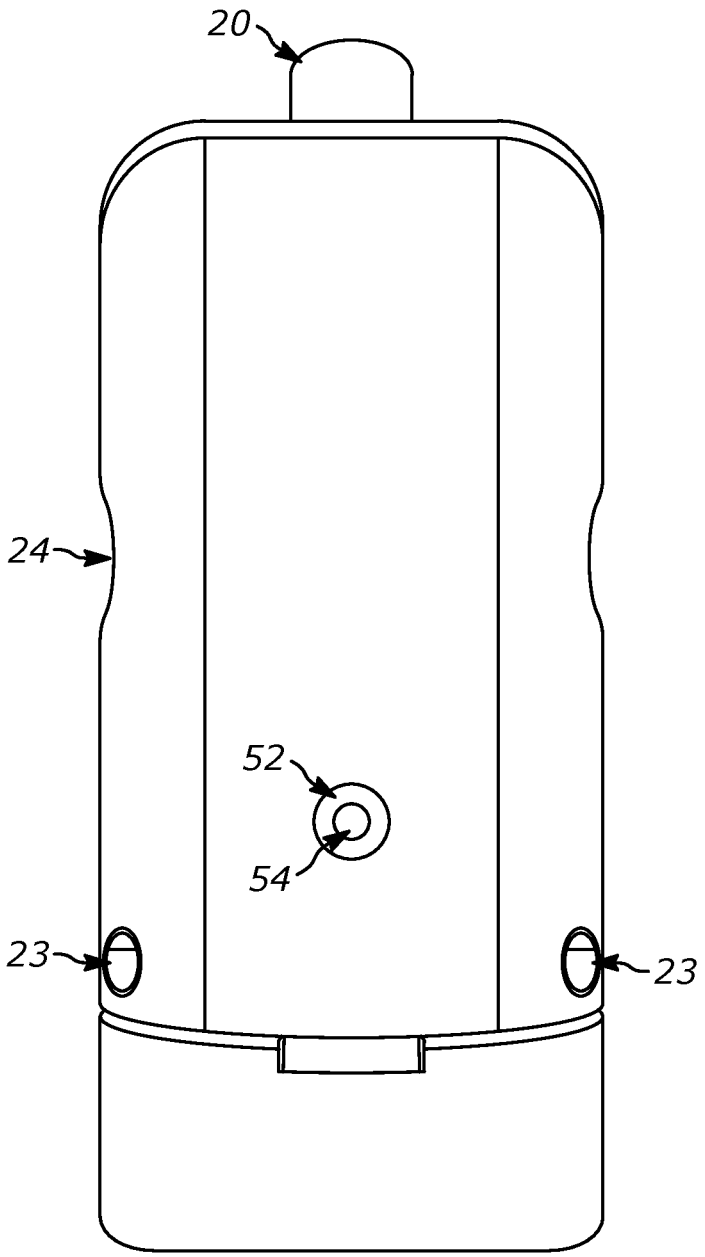
FIG. 5 is a perspective view of an example embodiment of the backstrap as viewed from the rear of the firearm when held in a firing position by the user, in accordance with an aspect of the present disclosure.

FIG. 5 illustrates a perspective view of an example embodiment of the backstrap 24 as viewed from the rear of the firearm 10 when held in a firing position by the user, in accordance with an aspect of the present disclosure.

As best shown therein, the backstrap 24 may include a cavity 52 and a tritium vial 54 on the top portion 21. In contrast to the cavity 26 and tritium vial 28 of FIG. 2 (which form a line of tritium illumination on the bottom portion 22), the cavity 52 and tritium vial 54 of FIG. 5 forms a circular point of tritium illumination on the top portion 21. In some embodiments, the tritium vial 54 may include a dome shaped lens to project tritium illumination along multiple angles and increase visibility of the tritium illumination to the user of the firearm.

Figure 6:
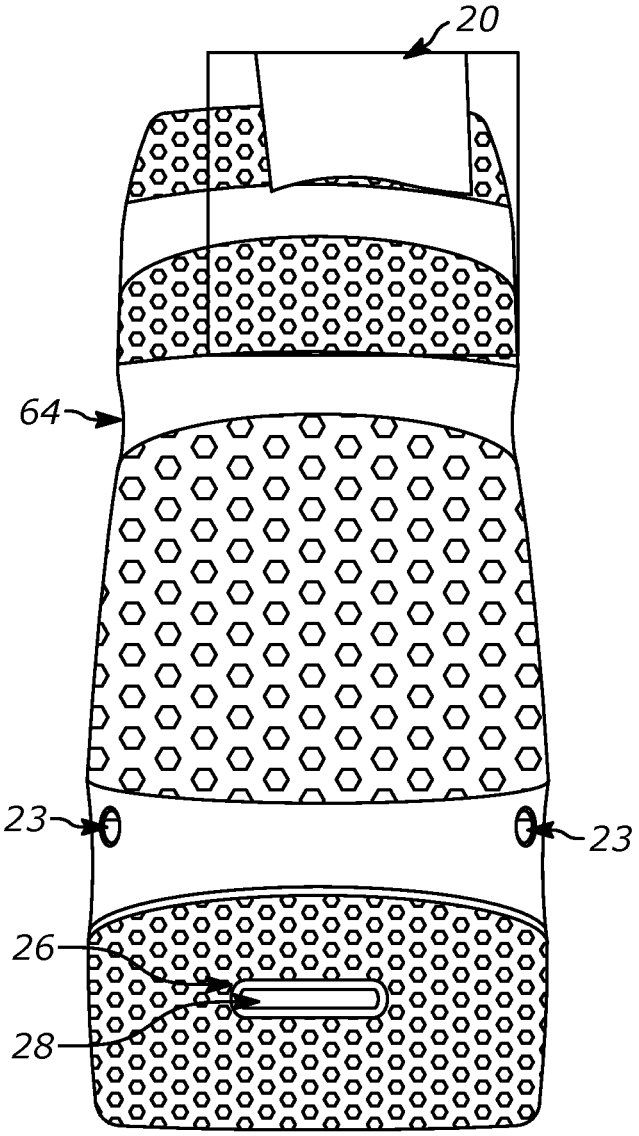
FIG. 6 is a perspective view of an example embodiment of the backstrap as viewed from the rear of the firearm when held in a firing position by the user, in accordance with an aspect of the present disclosure.

FIG. 6 illustrates a perspective view of an example embodiment of the backstrap 64 as viewed from the rear of the firearm 10 when held in a firing position by the user, in accordance with an aspect of the present disclosure.

As best shown therein, the backstrap 64 may be comprised of a single portion having at least one surface texture. According to one aspect, the backstrap 64 may include sections of surface textures which may increase the grip between the firearm grip 12 and the hands of the user when holding the firearm 10 in a firing position. According to one aspect, the textured surface may be any of, but not limited to, a rubberized surface texture, a lay surface texture, a wavy surface texture, a rough surface texture, a polished surface texture, a grit stone surface texture, a sandpaper surface texture, a glass bead blasted surface texture, a sand blasted surface texture, an electronic discharge machined molded surface texture, a satin blasted textured surface texture, a shiny finish, a semi-gloss finish, a matte finish, a textured finish, a granulate surface finish, and/or any combination thereof.

According to one aspect, the surface of backstrap 64 may alternate between a textured surface and a smooth surface as shown in FIG. 6. In some embodiments, the smooth surface may include a polished surface. In some embodiments, the textured surface may include a honey comb pattern (a.k.a., repeating hexagonal pattern).

According to one aspect, the backstrap 64 may include the member 20 extending from the top of backstrap 64 for guiding the backstrap 24 into a snapping position relative to the firearm grip 12. According to one aspect, the member 20 may not retain the textured surface of the top portion 21. According to one aspect, the member 20 may be utilized as part of a snap-fit joint and may include a snap-in area for locking into place with a cantilever setup. In some alternative embodiments, the member 20 may be configured for use in an annular snap-fit joint or a torsional snap-fit joint.

As best shown therein, the backstrap 64 may include one or more fastener holes 23 for affixing the backstrap 64 to the firearm grip 12. In some embodiments, the backstrap 24 may be configured to include one or more fastener holes 23 for attaching the backstrap 64 to the firearm by attaching a fastener through the fastener hole 23 and securing the backstrap 64 to the firearm grip 12. The fastener may be an adhesive, a mechanical fastener, a screw, a bolt, a nut, a rivet, a pin, a nail, a mechanical interlock, any appropriate fastening mechanism, or any combination thereof.

As best shown therein, the backstrap 64 may include the cavity 26 which may house the tritium vial 28 and may allow illumination to visibly escape the cavity 26. In some embodiments, a tritium vial may be comprised of a sealed glass container (e.g., borosilicate glass) filled with a gaseous form of tritium and a phosphor layer (e.g., doped zinc sulfide) applied to the inside of the glass vial. When the electrons emitted by the tritium gas interact with the phosphor layer, light is emitted. In some embodiments, different phosphor materials may be used to produce different colors (e.g., green, blue, red, yellow, orange, and white).

Figure 7A:
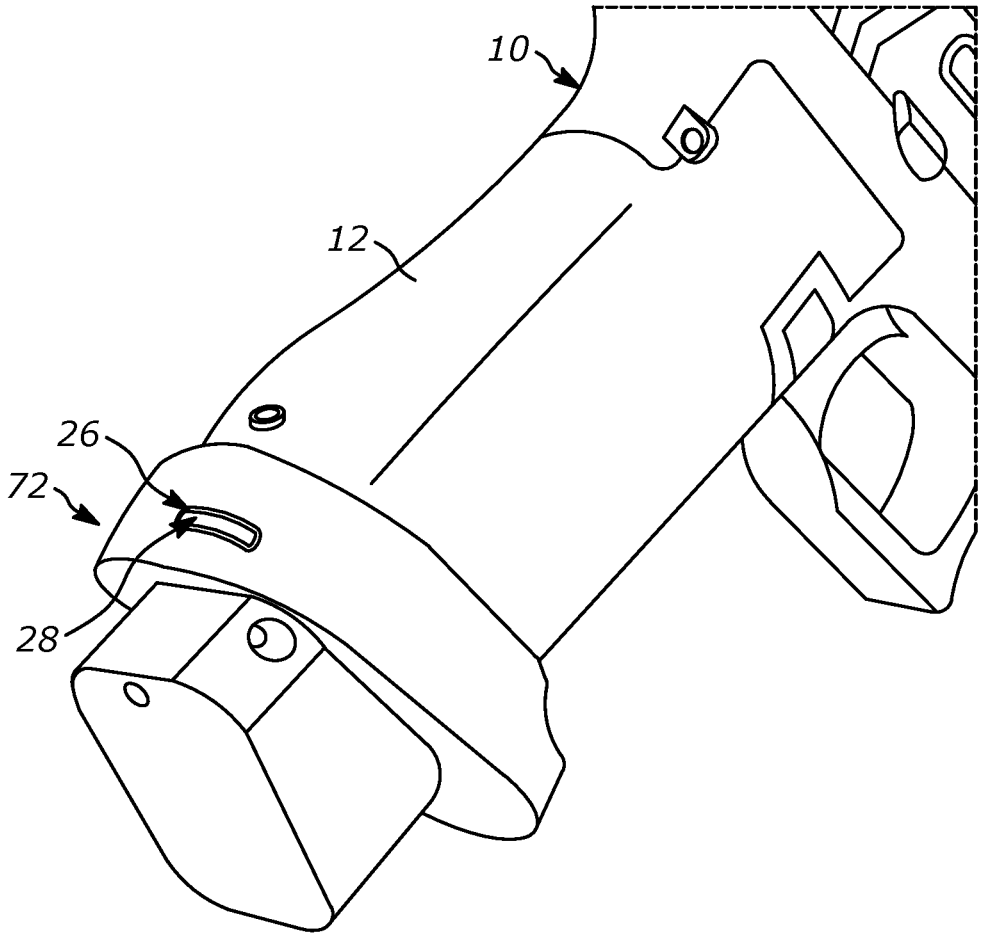
FIGS. 7A and 7B is a perspective view of an example embodiment of a magwell having a tritium light source embedded therein, in accordance with an aspect of the present disclosure.
Figure 7B:
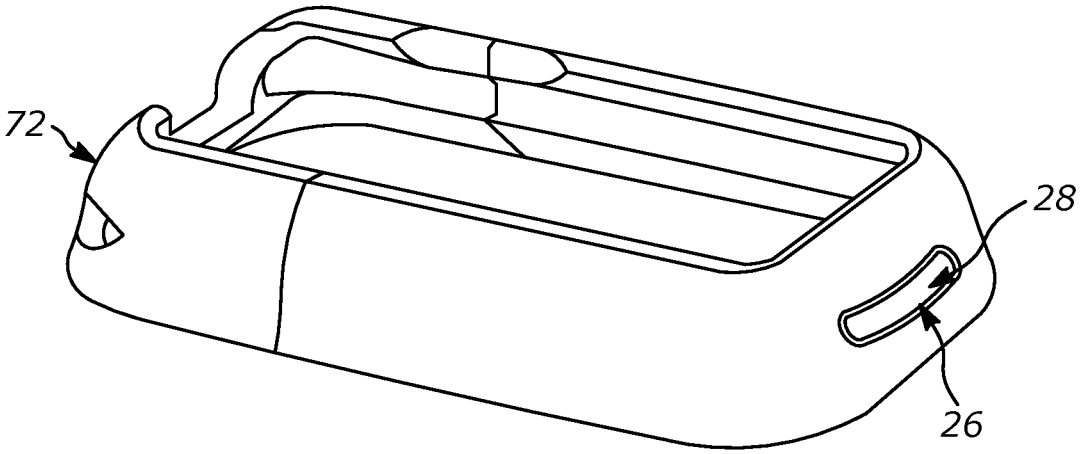

FIGS. 7A and 7B is a perspective view of an example embodiment of a magwell 72 having a tritium light source 28 embedded therein, in accordance with an aspect of the present disclosure.

As best shown therein, the magwell 72 may be attached at the base of the firearm grip 12. According to one aspect, the magwell 72 may allow for more consistent feeding of a magazine into the firearm 10. According to one aspect, the flared opening at the bottom of the magwell 72 directs the magazine into the firearm 10.

As best shown therein, the magwell 72 may include a cavity 26 which may house a tritium vial 28 and may allow illumination to visibly escape the cavity 26. In some embodiments, a tritium vial may be comprised of a sealed glass container (e.g., borosilicate glass) filled with a gaseous form of tritium and a phosphor layer (e.g., doped zinc sulfide) applied to the inside of the glass vial. When the electrons emitted by the tritium gas interact with the phosphor layer, light is emitted. In some embodiments, different phosphor materials may be used to produce different colors (e.g., green, blue, red, yellow, orange, and white).

According to one aspect, the tritium vial 28 on the magwell 72 may allow easier magazine swaps in low light conditions. According to one aspect, the illumination provided by the tritium vial 28 may allow a user to determine the orientation of the firearm and the location of the bottom of the firearm grip 12 in low light conditions. For example, the user may attempt to replace the magazine of the firearm 10 in low light conditions, the illumination provided by the tritium vial 28 illuminates the bottom of the firearm grip 10 where the magazine will be released and reloaded.

In some embodiments, the cavity 26 and the tritium vial 28 may be replaced with the cavity 32 and the tritium vial 34. In some embodiments, the cavity 26 and the tritium vial 28 may be replaced with the cavity 42 and the tritium vial 44. In some embodiments, the cavity 26 and the tritium vial 28 may be replaced with the cavity 52 and the tritium vial 54. The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in that particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or later, or intervening element or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to described various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A backstrap for mating with a handgrip of a firearm, comprising:

a body extending from a top portion to a bottom portion;

at least one of said top portion or bottom portion defining a cavity; and a tritium vial disposed in said cavity for allowing illumination produced by said tritium vial to be viewable by a user of the firearm.

2. The backstrap of claim 1, wherein the bottom portion defines the cavity extending horizontally along the bottom portion and the tritium vial is horizontally oriented with the bottom portion.

3. The backstrap of claim 1, wherein the top portion defines the cavity extending vertically along the top portion and the tritium vial is vertically oriented with the top portion.

4. The backstrap of claim 1, wherein the tritium vial is circular shaped and extends into the backstrap.

5. The backstrap of claim 1, wherein the backstrap has a member extending from the top portion of the backstrap for attaching to the firearm.

6. The backstrap of claim 1, wherein the top portion is detachable from the bottom portion.

7. The backstrap of claim 1, wherein the bottom portion includes at least one fastener hole for fitting a bolt through the bottom portion for securing the backstrap to the firearm.

8. The backstrap of claim 1, wherein the bottom portion includes an adherent surface.

9. A backstrap for mating with a handgrip of a firearm, comprising:

the backstrap shaped to conform to a shape of a portion of the handgrip of the firearm such that the firearm may be held in a firing position by the handgrip with the backstrap attached;

the backstrap may include a backstrap surface having an adherent surface interrupted by at least one horizontal section having a smooth surface; and the backstrap defining a cavity with at least one tritium vial disposed within said cavity for allowing illumination produced by said tritium vial to be viewable by a user of the firearm.

10. The backstrap of claim 9, wherein the adherent surface comprising of a repeating hexagonal pattern.

11. The backstrap of claim 9, wherein the backstrap defines the cavity extending horizontally along the backstrap and the tritium vial is horizontally oriented with the backstrap.

12. The backstrap of claim 9, wherein the backstrap has a member extending from a top of the backstrap for attaching to the firearm.

13. The backstrap of claim 9, wherein the backstrap includes at least one fastener holes for fitting a bolt through the backstrap for securing the backstrap to the firearm.

14. A magwell for mating with a handgrip of a firearm, comprising:

a body wrapping around the base of the hand grip of the firearm with a cavity allowing for replacing a magazine of the firearm;

the body defining a cavity; and a tritium vial disposed in said cavity for allowing illumination produced by said tritium vial to be viewable by a user of the firearm.

* * * * *